US008973507B2

(12) United States Patent
Kurahashi et al.

(10) Patent No.: US 8,973,507 B2
(45) Date of Patent: Mar. 10, 2015

(54) BOGIE FOR GUIDE RAIL TYPE VEHICLE

(75) Inventors: Hiroki Kurahashi, Mihara (JP); Nobuyuki Fujio, Mihara (JP); Hiroyuki Kono, Hiroshima (JP); Yukihide Yanobu, Hiroshima (JP); Akihisa Kawauchi, Hiroshima (JP); Kousuke Katahira, Kawasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 202 days.

(21) Appl. No.: 13/257,134

(22) PCT Filed: Jul. 6, 2009

(86) PCT No.: PCT/JP2009/062319

§ 371 (c)(1),
(2), (4) Date: Oct. 12, 2011

(87) PCT Pub. No.: WO2010/106697

PCT Pub. Date: Sep. 23, 2010

(65) Prior Publication Data

US 2012/0017800 A1 Jan. 26, 2012

(30) Foreign Application Priority Data

Mar. 17, 2009 (JP) ..... 2009-064767

(51) Int. Cl.
*B61F 9/00* (2006.01)
*B61B 10/04* (2006.01)

(52) U.S. Cl.
CPC ..... *B61B 10/04* (2013.01)
USPC ..... 105/72.2; 104/243; 104/247

(58) Field of Classification Search
USPC ..... 104/243, 245, 247; 105/72.2
See application file for complete search history.

(56) References Cited

U.S. PATENT DOCUMENTS

| | | | |
|---|---|---|---|
| 3,515,405 | A | 6/1970 | Segar |
| 4,089,272 | A | 5/1978 | Schmitz |
| 5,174,219 | A | 12/1992 | Streiff |
| 6,029,579 | A | 2/2000 | Andre et al. |

(Continued)

FOREIGN PATENT DOCUMENTS

| | | |
|---|---|---|
| CN | 86 1 04770 | 1/1988 |
| JP | 45-12884 B | 5/1970 |

(Continued)

OTHER PUBLICATIONS

JP Office Action for 2009-064767 dated Aug. 30, 2011.

(Continued)

*Primary Examiner* — Zachary Kuhfuss
(74) *Attorney, Agent, or Firm* — Lowe Hauptman & Ham, LLP

(57) ABSTRACT

The present invention provides a bogie for a guide rail type vehicle that runs along a predetermined guideway. The bogie includes a turn frame connected to a vehicle body; an axle turnably mounted to the turn frame via bearings and; a guide frame mounted to the axle; a first pair of guide wheels rotatably provided at a vehicle body end side portion of the guide frame; a second pair of guide wheels rotatably provided at a vehicle body center side portion of the guide frame; a stopper provided so as to project from an upper surface on a vehicle body side of the axle toward the vehicle body; and a pair of stopper receivers arranged facing each other at intervals from the stopper in a vehicle lateral direction.

8 Claims, 11 Drawing Sheets

(56) References Cited

U.S. PATENT DOCUMENTS

| | | | | |
|---|---|---|---|---|
| 6,308,640 | B1 | 10/2001 | Weule et al. | |
| 6,477,963 | B1 | 11/2002 | Weule et al. | |
| 2008/0083345 | A1 | 4/2008 | Morita et al. | |
| 2009/0301342 | A1 * | 12/2009 | Morichika et al. | 104/243 |

FOREIGN PATENT DOCUMENTS

| | | | |
|---|---|---|---|
| JP | 53-006404 | Y2 | 2/1978 |
| JP | 53074806 | U | 6/1978 |
| JP | 57-125673 | U | 8/1982 |
| JP | 59-158553 | A | 9/1984 |
| JP | 61006061 | A | 1/1986 |
| JP | 1-27492 | Y2 | 8/1989 |
| JP | 10-27492 | Y2 | 8/1989 |
| JP | 1027492 | Y2 | 8/1989 |
| JP | 2-91070 | U | 7/1990 |
| JP | 11-321635 | A | 11/1999 |
| JP | 2001-48007 | A | 2/2001 |
| JP | 2001-48008 | A | 2/2001 |
| JP | 2001511092 | A | 8/2001 |
| JP | 2002-211392 | A | 7/2002 |
| JP | 2006-175962 | A | 7/2006 |
| JP | 2006-205944 | A | 8/2006 |
| JP | 2006-205946 | A | 8/2006 |
| JP | 2006-306334 | A | 11/2006 |
| JP | 2006-347425 | A | 12/2006 |
| JP | 2008-068829 | A | 3/2008 |
| JP | 2008-265569 | | 11/2008 |
| WO | WO 2008/056685 | | 5/2008 |

OTHER PUBLICATIONS

A Japanese Office Action, dated May 11, 2012 in JP Application No. 2009-064767.

International Search Report for PCT/JP2009/062319 mailed Aug. 25, 2009.

JP Office Action, dated Sep. 7, 2012, issued in JP Application No. 2009-064767.

Notice of Allowance mailed May 17, 2013 corresponding to Japanese patent application No. 2009-064767.

Notice of Allowance granted Sep. 2, 2013 corresponds to Korean patent application No. 10-2011-7021570, for which an explanation of relevance is attached.

Japanese Office Action issued Aug. 30, 2011 in Japanese Patent Application No. 2009-064767.

Chinese Office Action issued Nov. 27, 2013 in Chinese Patent Applicatin No. 200980159285.0 with English language translation.

Notification of decision to grant a patent dated Nov. 3, 2014, corresponding to Chinese patent application No. 200980159285.0.

* cited by examiner

BOGIE FOR GUIDE RAIL TYPE VEHICLE

RELATED APPLICATIONS

The present application is a National Phase of International Application Number PCT/JP2009/062319, filed Jul. 6, 2009, and claims priority from, Japanese Application Number 2009-064767, filed Mar. 17, 2009.

TECHNICAL FIELD

The present invention relates to a guide rail type vehicle that runs along a predetermined guideway. More particularly, the present invention relates to a guide rail type vehicle, which is configured so as to be steered by being guided by a guide rail provided on the guideway.

BACKGROUND ART

There has been conventionally proposed a bogie for a guide rail type vehicle, which runs along a guide rail provided on a guideway by providing a steering mechanism using guide wheels (for example, see Patent Documents 1 and 2).

FIG. 11 shows one example of a conventional bogie for a guide rail type vehicle, and is a plan view of a bogie on the front side in the vehicle front and rear direction of a guide rail type vehicle.

As shown in FIG. 11, a bogie 62 of a guide rail type vehicle 61 runs along a guide rail 63 provided on a guideway, and is connected to a vehicle body (not shown) of the vehicle 61 via a traction link (not shown).

The bogie 62 includes a guide frame 64 formed in a rectangular shape in a plan view. A pair of guide wheels 65 is rotatably mounted to a vehicle body end side portion 64*a* of the guide frame 64. Meanwhile, a pair of guide wheels 66 is rotatably mounted to a vehicle body center side portion 64*b* of the guide frame 64. The guide wheels 65 and 66 are configured so as to rotate while being in contact with the side surfaces of the guide rail 63.

Also, the bogie 62 includes a pair of right and left running wheels 67. A steering lever 68 extending toward the vehicle body end side from the running wheel 67, and a first link lever 69 extending toward the vehicle body center side from the running wheel 67 are provided at the running wheel 67 on the left side relative to the vehicle running direction. An end part 68*a* on the vehicle body center side of the steering lever 68 and an end part 69*a* on the vehicle body end side of the first link lever 69 are connected to the running wheel 67 via a rotation shaft 70.

Meanwhile, a second link lever 71 extending toward the vehicle body center side from the running wheel 67 is provided at the running wheel 67 on the right side relative to the vehicle running direction. An end part 71*a* on the vehicle body end side of the second link lever 71 is connected to the running wheel 67 via a rotation shaft 72. Also, an end part 69*b* on the vehicle body center side of the first link lever 69 and an end part 71*b* on the vehicle body center side of the second link lever 71 are connected to each other by a tie rod 73 that extends in the vehicle lateral direction.

An actuator 74 is provided in the guide frame 64 of the bogie 62. The actuator 74 is connected to an end part 68*b* on the vehicle body end side of the steering lever 68 via a steering rod 75.

Based on the above-described configuration, in the conventional bogie 62, a distance L between the center of the guide frame 64 and the connection position of the actuator 74 and the steering rod 75 is changed by the actuator 74. Accordingly, the pair of right and left running wheels 67 is steered more than the turning angle of the guide frame 64.

PRIOR ART DOCUMENTS

Patent Documents

Patent Document 1: U.S. Pat. No. 6,477,963

Patent Document 2: Japanese Patent Laid-Open No. 11-321635

SUMMARY OF INVENTION

Problems to be Solved by the Invention

However, the aforementioned conventional configuration has a problem as described below when the bogie 62 runs along a curved section of the guide rail 63.

For example, when explained by using the running wheel 67 on the left side relative to the running direction as an example, the running wheel 67 on the left side is positioned outside the curved section in the case of a right-hand curve, and the running wheel 67 on the left side is positioned inside the curved section in the case of a left-hand curve even when the curvature radii of the curved sections of the guide rail 63 are equal to each other. Here, if the actuator 74 performs the same control in both the cases of the right-hand curve and the left-hand curve, the running wheel 67 is steered in the same manner in both the case in which the running wheel 67 on the left side is positioned inside the curved section and the case in which the running wheel 67 on the left side is positioned outside the curved section. That is, if the actuator 74 performs the same control in both the cases of the right-hand curve and the left-hand curve, the steering angle of the running wheel 67 positioned inside the curved section, and the steering angle of the running wheel 67 positioned outside the curved section are not equal in the cases of the right-hand curve and the left-hand curve. As a result, the tire and the like of the running wheel 67 may wear unevenly.

Moreover, the aforementioned conventional configuration has a problem that when the bogie 62 is displaced in the vehicle lateral direction while running, the vehicle body is also displaced in the vehicle lateral direction along with the bogie 62, so that the vehicle gives a passenger an uncomfortable ride. In addition, there is also a problem that an impact from the running wheels 67 or the guide wheels 65 and 66 of the bogie 62 is directly transmitted to the vehicle body through a traction link or the like, so that the vehicle gives a passenger a more uncomfortable ride.

The present invention has been made in view of the aforementioned circumstances, and it is an object of the invention to provide a bogie for a guide rail type vehicle, which can make the steering angles of running wheels equal in both the cases of right-hand and left-hand curves, and also can suppress the displacement in the vehicle lateral direction during running, and the transmission of an impact from guide wheels to a vehicle body.

Means for Solving the Problems

To achieve the above object of the related art, according to an embodiment of the present invention, a bogie for a guide rail type vehicle configured so as to be steered by being guided by a guide rail provided on a predetermined guideway when the bogie runs along the guideway, includes: a turn frame arranged below a vehicle body and connected to the vehicle body; an axle having a pair of running wheels and turnably mounted to the turn frame via a bearing; a guide frame mounted to the axle and formed so as to extend in a vehicle front and rear direction; a first pair of guide wheels arranged adjacent to each other in an axle direction so as to contact with the guide rail, and rotatably provided at a vehicle body end side portion in the vehicle front and rear direction of the guide frame; a second pair of guide wheels arranged adjacent to each other in the axle direction so as to contact the guide rail, and rotatably provided at a vehicle body center side portion in the vehicle front and rear direction of the guide frame; a stopper provided so as to project from an upper surface on a vehicle body side of the axle toward the vehicle body; and a pair of stopper receivers arranged facing each other at intervals from the stopper in a vehicle lateral direction, and provided so as to project from the vehicle body toward the axle.

Also, according to another embodiment of the present invention, the bogie for the guide rail type vehicle further includes a turn damper arranged so as to connect between the guide frame and the turn frame, to suppress a turning operation of the guide frame, and a restoration rod arranged so as to connect between the guide frame and the turn frame, to restore the guide frame to a straight-running state after the turning operation of the guide frame.

Also, according to another embodiment of the present invention, the guide frame is arranged at an offset position relative to a center axis of the axle toward a vehicle body end side in the vehicle front and rear direction such that a distance between the center axis of the axle and the first pair of guide wheels is greater than a distance between the center axis of the axle and the second pair of guide wheels.

Also, according to another embodiment of the present invention, the bogie further includes a first pair of guide wheel supports rotatably provided at the vehicle body end side portion of the guide frame so as to be arranged facing each other in the axle direction, each of the first pair of guide wheels being mounted to the vehicle body end side portion of the guide frame via each of the first pair of guide wheel supports, and the first pair of guide wheels being connected to each other by a shock-absorbing rod; and a second pair of guide wheel supports rotatably provided at the vehicle body center side portion of the guide frame so as to be arranged facing each other in the axle direction, each of the second pair of guide wheels being mounted to the vehicle body center side portion of the guide frame via each of the second pair of guide wheel supports, and the second pair of guide wheels being connected to each other by a shock-absorbing rod.

Also, according to another embodiment of the present invention, the bogie further includes a first guide wheel supporting member which connects the first pair of guide wheels to each other; a first pair of leaf springs provided at the vehicle body end side portion of the guide frame so as to be arranged facing each other in the axle direction, and the first guide wheel supporting member being mounted to the vehicle body end side portion of the guide frame via the first pair of leaf springs; a second guide wheel supporting member which connects the second pair of guide wheels to each other; and a second pair of leaf springs provided at the vehicle body center side portion of the guide frame so as to be arranged facing each other in the axle direction, and the second guide wheel supporting member being mounted to the vehicle body center side portion of the guide frame via the second pair of leaf springs.

Also, according to another embodiment of the present invention, the bogie further includes a first link which connects the first pair of guide wheels to each other, and is arranged tilting relative to the guide rail; a first link support which is provided at the vehicle body end side portion of the guide frame so as to extend toward the vehicle body end side in the vehicle front and rear direction, and the first link being rotatably mounted to the first link support via a first shock-absorbing mechanism having a restoration function; a second link which connects the second pair of guide wheels to each other, and is arranged tilting relative to the guide rail; and a second link support which is provided at the vehicle body center side portion of the guide frame so as to extend toward a vehicle body center side in the vehicle front and rear direction, and the second link being rotatably mounted to the second link support via a second shock-absorbing mechanism having a restoration function.

Advantageous Effects of Invention

According to the bogie for the guide rail type vehicle in accordance with the present invention, in the bogie for the guide rail type vehicle configured so as to be steered by being guided by the guide rail provided on the predetermined guideway when the bogie runs along the guideway, the bogie includes: the turn frame arranged below the vehicle body and connected to the vehicle body; the axle having the pair of running wheels and turnably mounted to the turn frame via the bearing; the guide frame mounted to the axle and formed so as to extend in the vehicle front and rear direction; the first pair of guide wheels arranged adjacent to each other in an axle direction so as to contact with the guide rail, and rotatably provided at the vehicle body end side portion in the vehicle front and rear direction of the guide frame; the second pair of guide wheels arranged adjacent to each other in the axle direction so as to contact the guide rail, and rotatably provided at the vehicle body center side portion in the vehicle front and rear direction of the guide frame; the stopper provided so as to project from an upper surface on the vehicle body side of the axle toward the vehicle body; and the pair of stopper receivers arranged facing each other at intervals from the stopper in the vehicle lateral direction, and provided so as to project from the vehicle body toward the axle. Thus, when the bogie passes through a curved section of the guide rail, the guide frame is guided by the guide rail, so that the axle and the guide frame are turned together. Accordingly, in both the cases of a right-hand curve and a left-hand curve, the axle and the guide frame are turned in the same manner, and the steering angles of the running wheels become equal. A tire can be thereby prevented from wearing unevenly.

Also, even when the bogie is displaced in the vehicle lateral direction when passing through the curved section of the guide rail, the stopper provided on the axle abuts against the stopper receiver on the vehicle body side, and the displacement of the bogie in the vehicle lateral direction can be suppressed. Thus, the displacement of the vehicle body in the vehicle lateral direction is also suppressed, and as a result, the vehicle can give a passenger a more comfortable ride. In addition, since the pair of stopper receivers are arranged at intervals from the stopper in the vehicle lateral direction, an impact from the running wheels or the guide wheels of the bogie is prevented from being transmitted to the vehicle body. As a result, the vehicle can give a passenger a much more comfortable ride.

Also, in the bogie for the guide rail type vehicle according to the present invention, the bogie further includes the turn damper arranged so as to connect the guide frame and the turn frame, to suppress the turning operation of the guide frame, and the restoration rod arranged so as to connect the guide frame and the turn frame, to restore the guide frame to the straight-running state after the turning operation of the guide frame. Thus, when the bogie passes through the curved section of the guide rail, the rapid turning of the axle and the guide frame is suppressed by the turn damper. As a result, the bogie can be prevented from vibrating when passing through the curved section of the guide rail. In addition, the guide frame is immediately restored to a straight-running state by the restoration rod after the bogie passes through the curved section of the guide rail. Accordingly, the bogie can stably run along a portion in which the guide rail is changed from a curve line to a straight line.

Also, in the bogie for the guide rail type vehicle according to the present invention, the guide frame is arranged at an offset position relative to the center axis of the axle toward the vehicle body end side in the vehicle front and rear direction such that the distance between the center axis of the axle and the first pair of guide wheels is greater than the distance between the center axis of the axle and the second pair of guide wheels. Thus, for example, when the bogie on the front side of the vehicle passes through the curved section of the guide rail, the running wheel is turned by a predetermined angle (a slip angle) toward the inside of the curve relative to the tangential direction of the curve at the position of the running wheel. Accordingly, a cornering force is generated in the tire of the running wheel toward the inside of the curve. That is, when the bogie passes through the curved section of the guide rail, a cornering force is generated in the direction opposite to a centrifugal force acting on the bogie. The load acting on the first and second guide wheels is thereby reduced. As a result, the service life of the first and second guide wheels can be further extended.

In addition, for example, in the case of the bogie on the front side, the distance between the center axis of the axle and the first pair of guide wheels is greater than the distance between the center axis of the axle and the second pair of guide wheels. Thus, the load acting on the first guide wheels is reduced based on a lever ratio, and as a result, the service life of the first guide wheels can be further extended.

Also, for example, in the case of the bogie on the front side, the guide frame is arranged frontward from the center position of the axle. Thus, the guide frame is guided by the guide rail slightly before the axle, and a trailing effect is generated such that the axle easily follows the guide frame. Accordingly, the running stability of the bogie is further improved.

Also, in the bogie for the guide rail type vehicle according to the present invention, the bogie further includes the first pair of guide wheel supports rotatably provided at the vehicle body end side portion of the guide frame so as to be arranged facing each other in the axle direction, each of the first pair of guide wheels being mounted to the vehicle body end side portion of the guide frame via each of the first pair of guide wheel supports, and the first pair of guide wheels being connected to each other by the shock-absorbing rod; and the second pair of guide wheel supports rotatably provided at the vehicle body center side portion of the guide frame so as to be arranged facing each other in the axle direction, each of the second pair of guide wheels being mounted to the vehicle body center side portion of the guide frame via each of the second pair of guide wheel supports, and the second pair of guide wheels being connected to each other by the shock-absorbing rod. Thus, when the bogie runs along the curved section of the guide rail or a joint of the guide rail or the like, an impact on the first and second guide wheels is absorbed by the shock-absorbing rods, and is thus prevented from being transmitted to the guide frame and the bogie. Accordingly, the running stability of the bogie is improved, and the vehicle can give a passenger a more comfortable ride. An impact on the first and second guide wheels themselves is also reduced by the shock-absorbing rods, so that the operating life of the first and second guide wheels can be extended.

Also, in the bogie for the guide rail type vehicle according to the present invention, the bogie further includes the first guide wheel supporting member which connects the first pair of guide wheels to each other; the first pair of leaf springs provided at the vehicle body end side portion of the guide frame so as to be arranged facing each other in the axle direction, and the first guide wheel supporting member being mounted to the vehicle body end side portion of the guide frame via the first pair of leaf springs; the second guide wheel supporting member which connects the second pair of guide wheels to each other; and the second pair of leaf springs provided at the vehicle body center side portion of the guide frame so as to be arranged facing each other in the axle direction, and the second guide wheel supporting member being mounted to the vehicle body center side portion of the guide frame via the second pair of leaf springs. Thus, when the bogie runs along the curved section of the guide rail or the joint of the guide rail or the like, an impact on the first and second guide wheels is absorbed by the leaf springs, and is thus prevented from being transmitted to the guide frame and the bogie. Accordingly, the running stability of the bogie is improved, and the vehicle can give a passenger a more comfortable ride. An impact on the first and second guide wheels themselves is also reduced by the leaf springs, so that the operating life of the first and second guide wheels can be extended.

Moreover, since the leaf springs, which are not a wear component, are used to connect the guide wheel supporting member to the guide frame, the replacement cycle becomes longer, and the maintainability is also improved.

Also, in the bogie for the guide rail type vehicle bogie according to the present invention, the bogie further includes the first link which connects the first pair of guide wheels to each other, and is arranged tilting relative to the guide rail; the first link support which is provided at the vehicle body end side portion of the guide frame so as to extend toward the vehicle body end side in the vehicle front and rear direction, and the first link being rotatably mounted to the first link support via the first shock-absorbing mechanism having the restoration function; the second link which connects the second pair of guide wheels to each other, and is arranged tilting relative to the guide rail; and the second link support which is provided at the vehicle body center side portion of the guide frame so as to extend toward the vehicle body center side in the vehicle front and rear direction, and the second link being rotatably mounted to the second link support via the second shock-absorbing mechanism having the restoration function. Thus, when the bogie runs along the curved section of the guide rail or the joint of the guide rail or the like, an impact on the first and second guide wheels is absorbed by the rotating first and second links, and is thus prevented from being transmitted to the guide frame and the bogie. Accordingly, the running stability of the bogie is improved, and the vehicle can give a passenger a more comfortable ride. An impact on the first and second guide wheels themselves is also reduced by the rotating first and second links, so that the operating life of the first and second guide wheels can be extended.

BRIEF DESCRIPTION OF DRAWINGS

FIG. 10(*a*) is a plan view of the guide rail; and FIG. 10(*b*) is a sectional view of the guide rail.

DESCRIPTION OF EMBODIMENTS

First Embodiment

Figure 1:
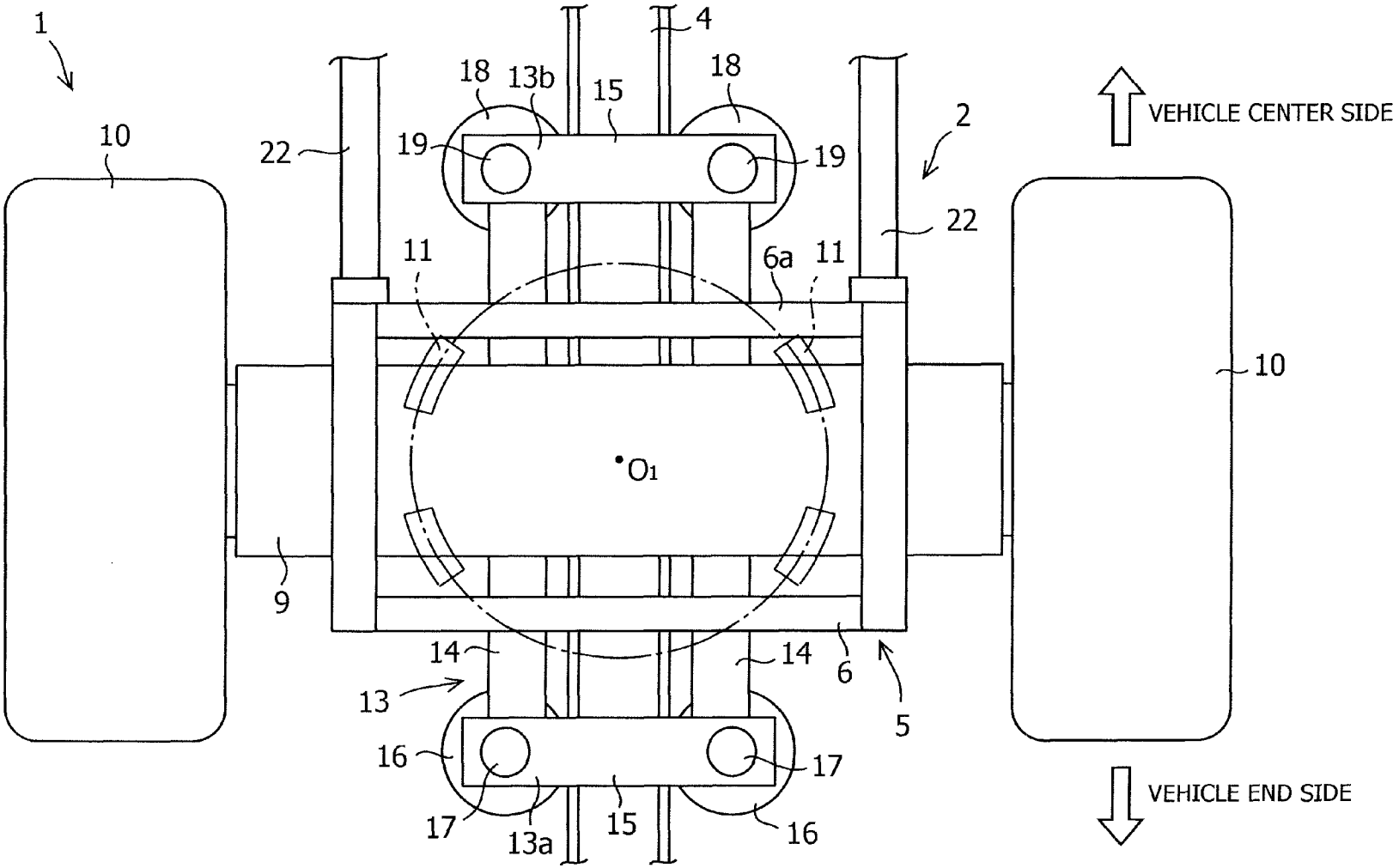
FIG. 1 is a plan view of a bogie on the front side in the vehicle front and rear direction of a guide rail type vehicle according to a first embodiment of the present invention.
Figure 2:
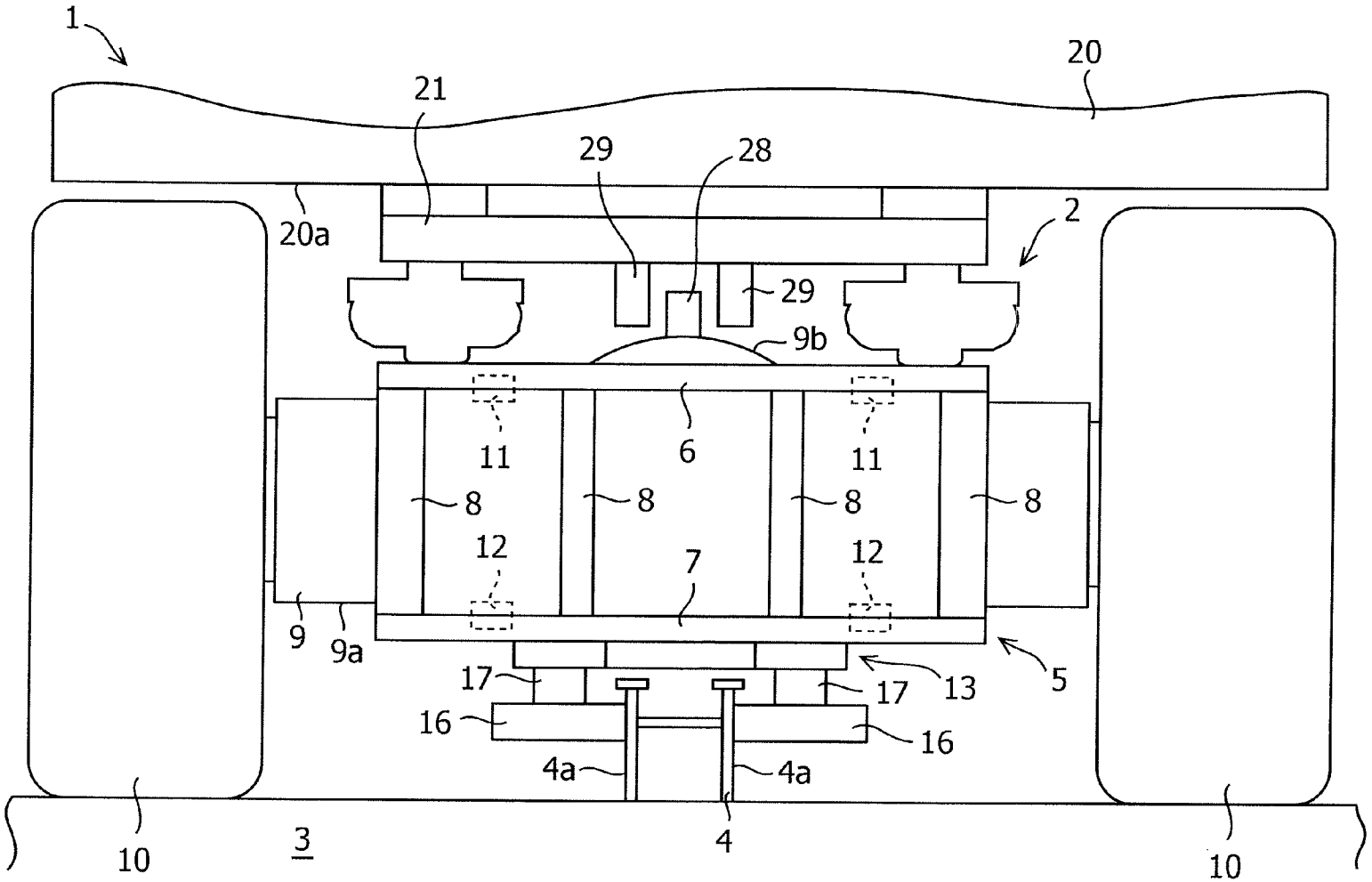
FIG. 2 is a front view of the bogie in FIG. 1 as viewed from the vehicle body end side.
Figure 3:
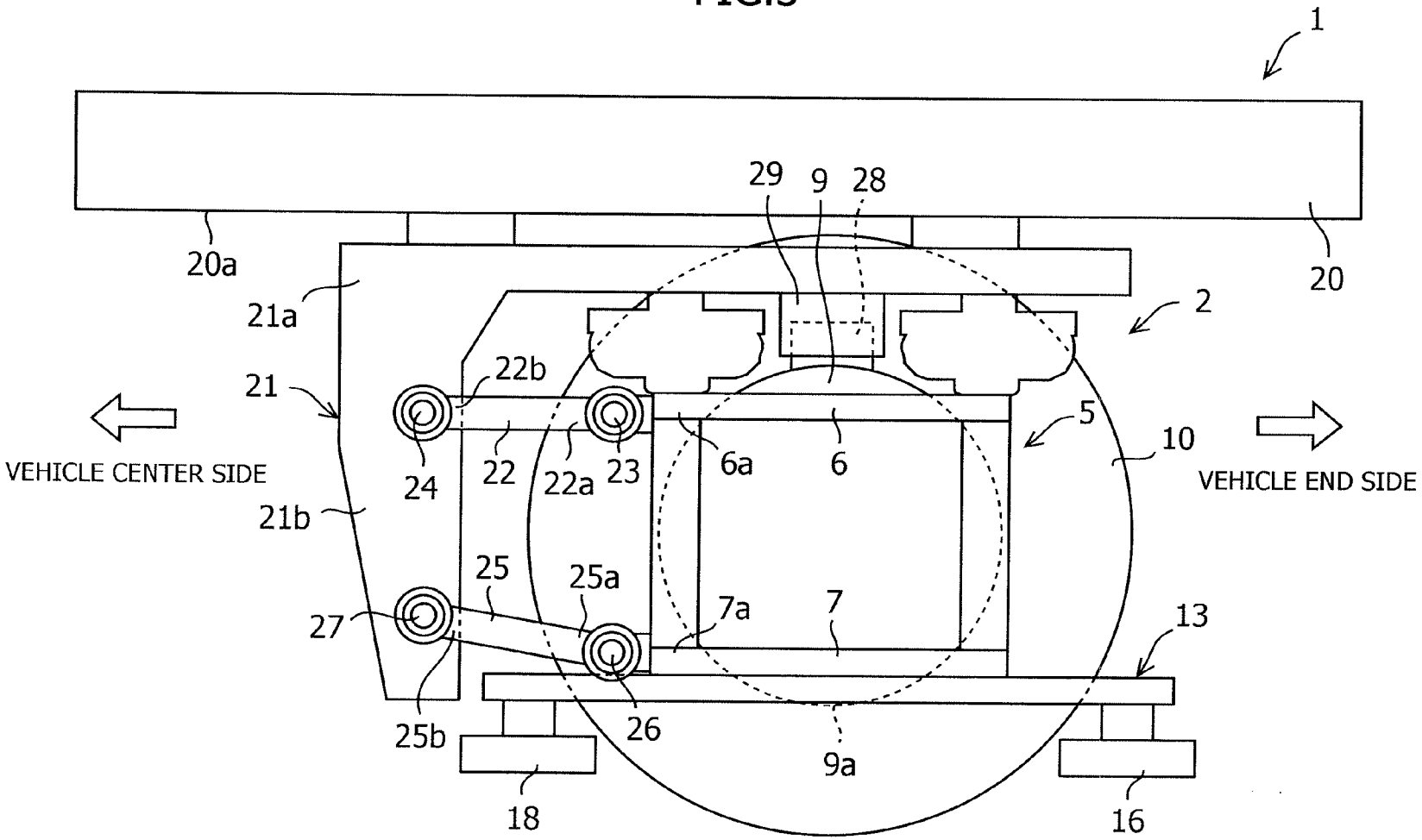
FIG. 3 is a side view of the bogie in FIG. 1 as viewed from the vehicle lateral direction.

In the following, a bogie for a guide rail type vehicle according to a first embodiment of the present invention will be described with reference to the drawings. FIG. 1 is a plan view of a bogie on the front side in the vehicle front and rear direction of a guide rail type vehicle according to the first embodiment of the present invention. FIG. 2 is a front view of the bogie in FIG. 1 as viewed from the vehicle body end side. FIG. 3 is a side view of the bogie in FIG. 1 as viewed from outside in the vehicle lateral direction.

As shown in FIGS. 1 and 2, a vehicle 1 includes a bogie 2 at each of a front portion and a rear portion (the rear portion is not shown) in the vehicle front and rear direction, and runs along a predetermined guideway 3. A guide rail 4 having an H shape in section is laid on a substantially center part in the vehicle lateral direction of the guideway 3.

As shown in FIGS. 1 and 2, the bogie 2 includes a turn frame 5 assembled in a rectangular parallelepiped shape so as to have a rectangular shape in a plan view and a side view. The turn frame 5 includes an upper rectangular frame 6, a lower rectangular frame 7, and a plurality of connecting frames 8 that extend in the vehicle vertical direction and connect between the upper rectangular frame 6 and the lower rectangular frame 7.

As shown in FIGS. 1 and 2, the bogie 2 includes an axle 9 that extends in the vehicle lateral direction. A pair of running wheels 10 is mounted to both end parts in the vehicle lateral direction of the axle 9. Also, the axle 9 is arranged so as to pass through the inside of the turn frame 5 in the vehicle lateral direction. An arc-shaped bearing 11 (for example, an R guide) is arranged between the axle 9 and the upper rectangular frame 6 of the turn frame 5. Meanwhile, an arc-shaped bearing 12 (for example, an R guide) is also arranged between the axle 9 and the lower rectangular frame 7 of the turn frame 5. Accordingly, the axle 9 can be turned along the alternating long and short dashed line (see FIG. 1) relative to the turn frame 5 with a center axis $O_1$ of the axle 9 as the rotation center.

As shown in FIGS. 1 to 3, a guide frame 13 is provided on a lower surface 9*a* of the axle 9. The guide frame 13 is formed in a rectangular shape in a plan view, and includes two longitudinal frames 14 extending in the vehicle front and rear direction, and two lateral frames 15 connecting the two longitudinal frames 14 at both end parts in the vehicle front and rear direction thereof.

As shown in FIGS. 1 to 3, at a vehicle body end side portion 13*a* in the vehicle front and rear direction of the guide frame 13, a first pair of guide wheels 16 is provided so as to face each other with the guide rail 4 therebetween. Each of the first guide wheels 16 is laterally arranged so as to contact an outer side surface 4*a* of the guide rail 4. A center portion thereof is rotatably mounted to the guide frame 13 via a rotation shaft 17.

Also, at a vehicle body center side portion 13*b* in the vehicle front and rear direction of the guide frame 13, a second pair of guide wheels 18 is provided so as to face each other with the guide rail 4 therebetween. Each of the second guide wheels 18 is laterally arranged so as to contact the outer side surface 4*a* of the guide rail 4. A center portion thereof is rotatably mounted to the guide frame 13 via a rotation shaft 19.

As shown in FIGS. 2 and 3, a suspension frame 21 is provided on a lower surface 20*a* of a vehicle body 20 of the vehicle 1 at a position corresponding to the bogie 2. The suspension frame 21 is formed so as to extend in the vehicle front and rear direction, and an extension part 21*b* is provided at a vehicle body center side portion 21*a* of the suspension frame 21 so as to extend downward.

As shown in FIG. 3, the extension part 21*b* of the suspension frame 21 and a vehicle body center side portion 6*a* of the upper rectangular frame 6 of the turn frame 5 are connected to each other by two traction links 22. Here, an end part 22*a* on the vehicle body end side of the traction link 22 is rotatably mounted to the upper rectangular frame 6 via a joint 23, and an end part 22*b* on the vehicle body center side of the traction link 22 is rotatably mounted to the extension part 21*b* of the suspension frame 21 via a joint 24.

Also, the extension part 21*b* of the suspension frame 21 and a vehicle body center side portion 7*a* of the lower rectangular frame 7 of the turn frame 5 are connected to each other by two traction links 25. Here, an end part 25*a* on the vehicle body end side of the traction link 25 is rotatably mounted to the lower rectangular frame 7 via a joint 26, and an end part 25*b* on the vehicle body center side of the traction link 25 is rotatably mounted to the extension part 21*b* of the suspension frame 21 via a joint 27.

In the present embodiment, as shown in FIGS. 2 and 3, a stopper 28 is provided on an upper surface (a side surface on the vehicle body 20 side) 9*b* of the axle 9 so as to project toward the vehicle body 20. The stopper 28 is formed in a rectangular parallelepiped shape, and is arranged so as to extend in the vehicle front and rear direction. A pair of rubber stopper receivers 29 is also provided on the suspension frame 21 so as to project toward the axle 9. The pair of stopper receivers 29 is formed in a rectangular parallelepiped shape, and arranged facing each other at intervals from the stopper 28 in the vehicle lateral direction.

Although not shown in the drawings, in the present embodiment, the bogie on the rear side of the vehicle 1 has the same features as those in the aforementioned embodiment.

The bogie for the guide rail type vehicle according to the present embodiment includes the turn frame 5 connected to the vehicle body 20, the axle 9 turnably mounted to the turn frame 5 via the bearings 11 and 12, the guide frame 13 mounted to the axle 9 and formed so as to extend in the vehicle front and rear direction, the first pair of guide wheels 16 rotatably provided at the vehicle body end side portion 13*a* in the vehicle front and rear direction of the guide frame 13, the second pair of guide wheels 18 rotatably provided at the vehicle body center side portion 13*b* in the vehicle front and rear direction of the guide frame 13, the stopper 28 provided so as to project from the upper surface 9*b* on the vehicle body side of the axle 9 toward the vehicle body 20, and the pair of stopper receivers 29 arranged facing each other at intervals from the stopper 28 in the vehicle lateral direction, and provided so as to project from the vehicle body 20 toward the axle 9. Thus, when the bogie 2 passes through a curved section of the guide rail 4, the guide frame 13 is guided by the guide rail 4, and the axle 9 and the guide frame 13 are turned together. Accordingly, the axle 9 and the guide frame 13 are turned in the same manner in both the cases of a right-hand curve and a left-hand curve, so that the steering angles of the running wheels 10 become equal. A tire can be thereby prevented from wearing unevenly.

Also, even when the bogie 2 is displaced in the vehicle lateral direction when passing through the curved section of the guide rail 4, the stopper 28 provided on the axle 9 abuts against the stopper receivers 29 on the vehicle body side, and the displacement of the bogie 2 in the vehicle lateral direction can be suppressed. Thus, the displacement of the vehicle body 20 in the vehicle lateral direction is also suppressed, and as a result, the vehicle 1 can give a passenger a more comfortable ride. In addition, since the pair of stopper receivers 29 is arranged at intervals from the stopper 28 in the vehicle lateral direction, an impact from the running wheels 10 or the guide wheels 16 and 18 of the bogie 2 is prevented from being transmitted to the vehicle body 20. As a result, the vehicle 1 can give a passenger a much more comfortable ride. That is, a large displacement in the vehicle lateral direction is suppressed, and other impacts such as vibrations are not transmitted to the vehicle body.

Second Embodiment

Figure 4:
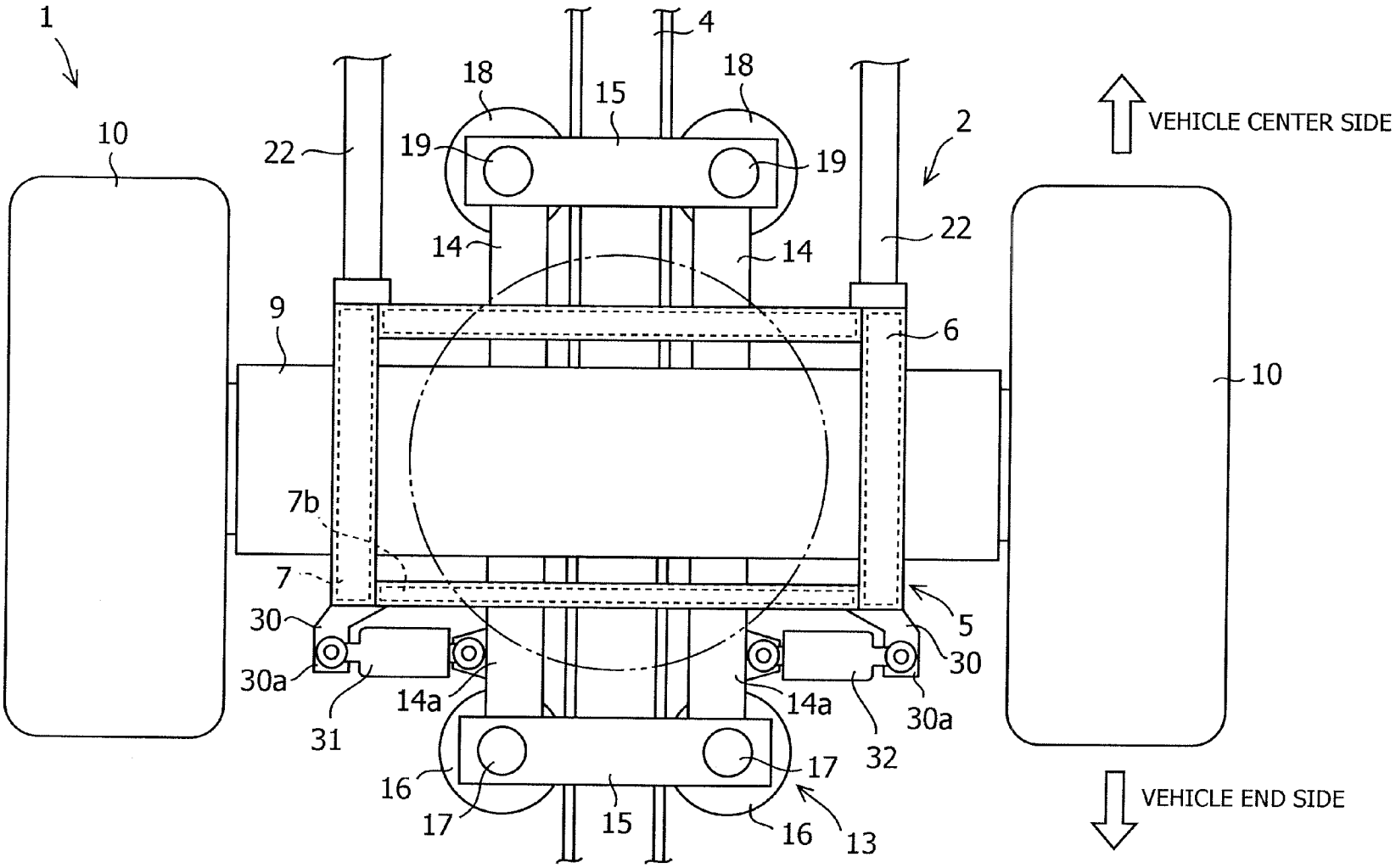
FIG. 4 is a plan view of a bogie on the front side in the vehicle front and rear direction of a guide rail type vehicle according to a second embodiment of the present invention.

In the following, a bogie for a guide rail type vehicle according to a second embodiment of the present invention will be described with reference to the drawings. FIG. 4 is a plan view of a bogie on the front side in the vehicle front and rear direction of a guide rail type vehicle according to the second embodiment of the present invention. In this embodiment, the same symbols are applied to elements that are the same as those explained in the above-described embodiments, and repeated explanation thereof is omitted.

In the present embodiment, as shown in FIG. 4, at a vehicle body end side portion 7*b* of the lower rectangular frame 7 of the turn frame 5, a pair of arms 30 is provided so as to be formed extending toward the vehicle body end side. An end part 30*a* on the vehicle body end side of the right arm 30 relative to the vehicle running direction, and a vehicle body end side portion 14*a* of the longitudinal frame 14 of the guide frame 13 are connected to each other by a turn damper 31 that extends in the vehicle lateral direction. The turn damper 31 suppresses the rapid turning operation of the guide frame 13 when the vehicle 1 passes through the curved section (not shown) of the guide rail 4.

Also, an end part 30*a* on the vehicle body end side of the left arm 30 relative to the vehicle running direction, and a vehicle body end side portion 14*a* of the longitudinal frame 14 of the guide frame 13 are connected to each other by a restoration rod 32 that extends in the vehicle lateral direction. The restoration rod 32 restores the guide frame 13 to a straight-running state after the turning operation of the guide frame 13 (after the vehicle 1 passes through the curved section of the guide rail 4).

Although not shown in the drawings, in the present embodiment, the bogie on the rear side of the vehicle 1 has the same features as those in the aforementioned embodiment.

As described above, the bogie for the guide rail type vehicle according to the present embodiment includes the turn damper 31 arranged so as to connect the guide frame 13 and the turn frame 5, to suppress the turning operation of the guide frame 13, and the restoration rod 32 arranged so as to connect the guide frame 13 and the turn frame 5, to restore the guide frame 13 to the straight-running state after the turning operation of the guide frame 13. Thus, when the bogie 2 passes through the curved section of the guide rail 4, the rapid turning of the axle 9 and the guide frame 13 is suppressed by the turn damper 31. As a result, the bogie 2 can be prevented from vibrating when passing through the curved section of the guide rail 4. In addition, the guide frame 13 is immediately restored to the straight-running state by the restoration rod 32 after the bogie 2 passes through the curved section of the guide rail 4. Accordingly, the bogie 2 can stably run along a portion in which the guide rail 4 is changed from a curve line to a straight line.

Third Embodiment

Figure 5:
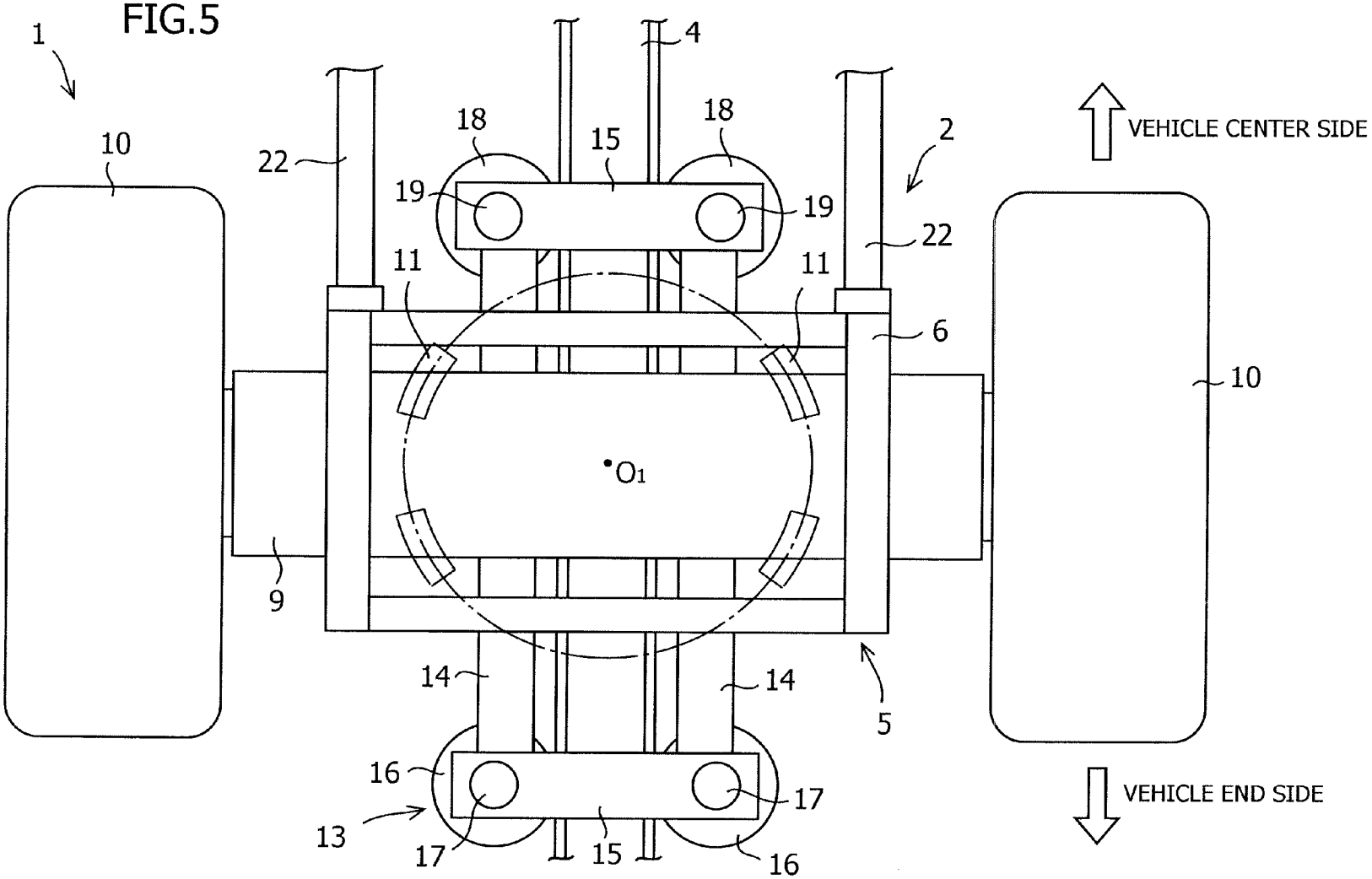
FIG. 5 is a plan view of a bogie on the front side in the vehicle front and rear direction of a guide rail type vehicle according to a third embodiment of the present invention.
Figure 6:
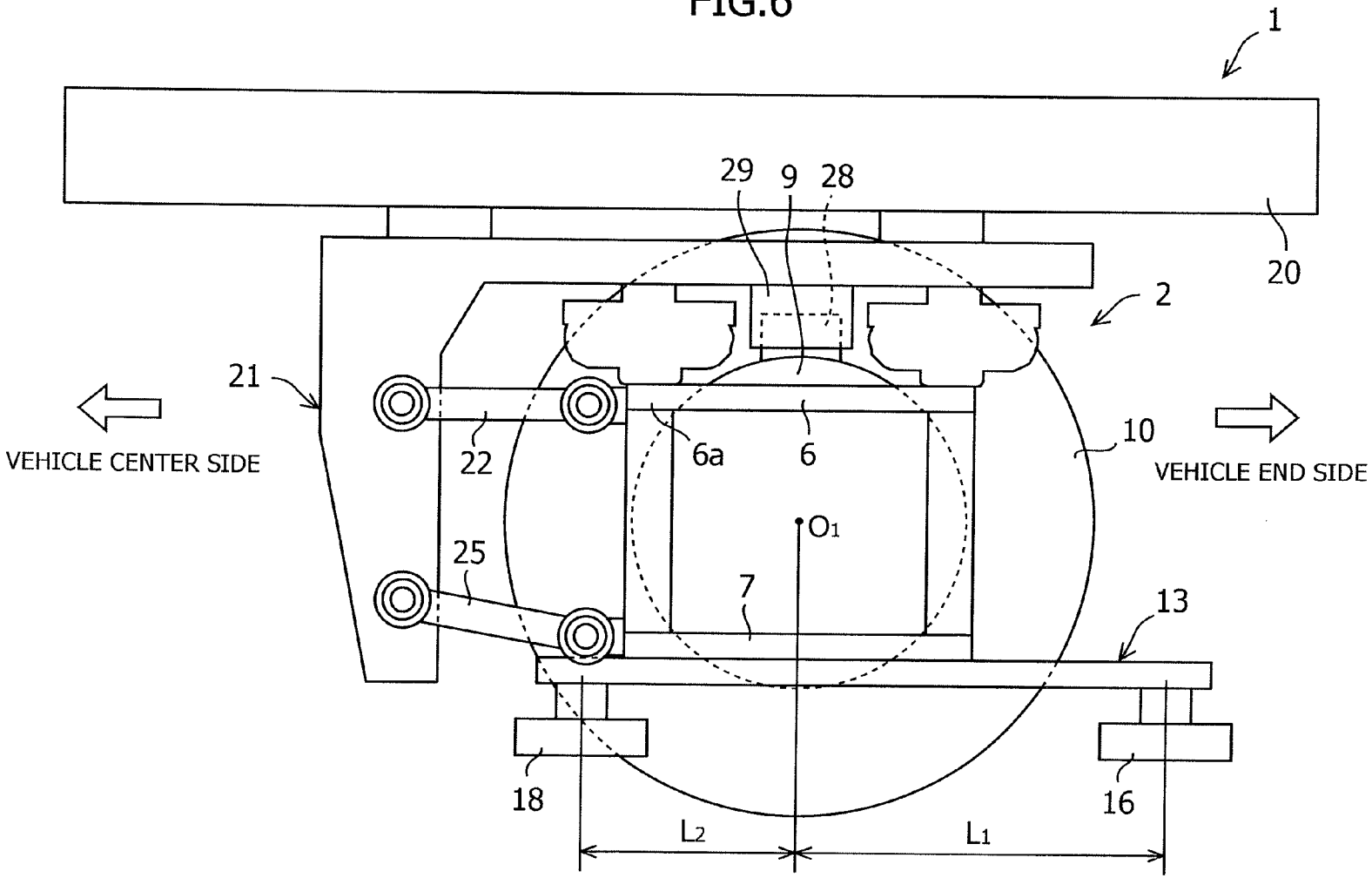
FIG. 6 is a side view of the bogie in FIG. 5 as viewed from outside in the vehicle lateral direction.

In the following, a bogie for a guide rail type vehicle according to a third embodiment of the present invention will be described with reference to the drawings. FIG. 5 is a plan view of a bogie on the front side in the vehicle front and rear direction of a guide rail type vehicle according to the third embodiment of the present invention. FIG. 6 is a side view of the bogie in FIG. 5 as viewed from outside in the vehicle lateral direction. In this embodiment, the same symbols are applied to elements that are the same as those explained in the above-described embodiments, and repeated explanation thereof is omitted.

In the present embodiment, as shown in FIGS. 5 and 6, the guide frame 13 is arranged at an offset position relative to the center axis $O_1$ of the axle 9 toward the vehicle body end side in the vehicle front and rear direction such that a distance $L_1$ between the center axis $O_1$ of the axle 9 and the first pair of guide wheels 16 is greater than a distance $L_2$ between the center axis $O_1$ of the axle 9 and the second pair of guide wheels 18. Although not shown in the drawings, in the present embodiment, the bogie on the rear side of the vehicle 1 has the same features as those in the aforementioned embodiment.

As described above, in the bogie for the guide rail type vehicle according to the present embodiment, the guide frame 13 is arranged at an offset position relative to the center axis $O_1$ of the axle 9 toward the vehicle body end side in the vehicle front and rear direction such that the distance $L_1$ between the center axis $O_1$ of the axle 9 and the first pair of guide wheels 16 is greater than the distance $L_2$ between the center axis $O_1$ of the axle 9 and the second pair of guide wheels 18. Thus, for example, when the bogie 2 on the front side of the vehicle 1 passes through the curved section of the guide rail 4, the running wheel 10 is turned by a predetermined angle (a slip angle) toward the inside of the curve relative to the tangential direction of the curve at the position of the running wheel 10. Accordingly, a cornering force is generated in the tire of the running wheel 10 toward the inside of the curve. That is, when the bogie 2 on the front side passes through the curved section of the guide rail 4, a cornering force is generated in the direction opposite to a centrifugal force acting on the bogie 2. The load acting on the first and second guide wheels 16 and 18 is thereby reduced. As a result, the service life of the first and second guide wheels 16 and 18 can be further extended.

In addition, for example, in the case of the bogie 2 on the front side, the distance $L_1$ between the center axis $O_1$ of the axle 9 and the first pair of guide wheels 16 is greater than the distance $L_2$ between the center axis $O_1$ of the axle 9 and the second pair of guide wheels 18. Thus, the load acting on the first guide wheels 16 is reduced based on a lever ratio, and as a result, the service life of the first guide wheels 16 can be further extended.

Also, for example, in the case of the bogie 2 on the front side, the guide frame 13 is arranged frontward from the center axis $O_1$ of the axle 9. Thus, the guide frame 13 is guided by the guide rail 4 slightly before the axle 9, and a trailing effect is generated such that the axle 9 easily follows the guide frame 13. Accordingly, the running stability of the bogie 2 is further improved.

Fourth Embodiment

Figure 7:
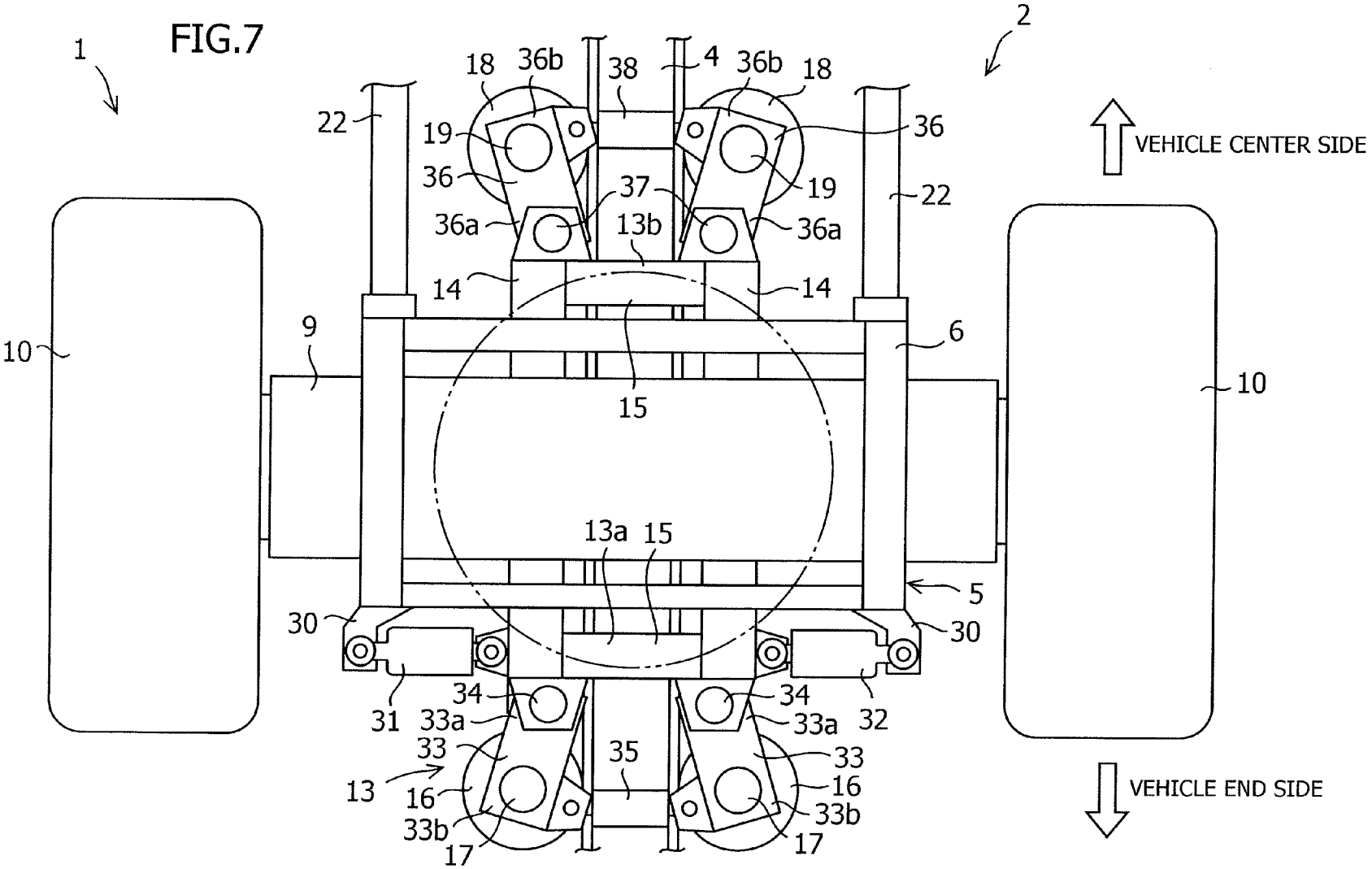
FIG. 7 is a plan view of a bogie on the front side in the vehicle front and rear direction of a guide rail type vehicle according to a fourth embodiment of the present invention.

In the following, a bogie for a guide rail type vehicle according to a fourth embodiment of the present invention will be described with reference to the drawings. FIG. 7 is a plan view of a bogie on the front side in the vehicle front and rear direction of a guide rail type vehicle according to the fourth embodiment of the present invention. In this embodiment, the same symbols are applied to elements that are the same as those explained in the above-described embodiments, and repeated explanation thereof is omitted.

In the present embodiment, as shown in FIG. 7, at the vehicle body end side portion 13*a* of the guide frame 13, a first pair of guide wheel supports 33 is provided so as to be arranged facing each other with the guide rail 4 therebetween. Each of the first guide wheel supports 33 is arranged so as to extend toward the vehicle body end side in the vehicle front and rear direction. A vehicle body center side portion 33*a* of each of the first guide wheel supports 33 is rotatably mounted to the guide frame 13 via a rotation shaft 34. Also, the first guide wheel 16 is rotatably mounted to a vehicle body end side portion 33*b* of each of the first guide wheel supports 33 via the rotation shaft 17.

In the present embodiment, as shown in FIG. 7, the vehicle body end side portions 33*b* of the first pair of guide wheel supports 33 are connected to each other by a shock-absorbing rod 35 that extends in the vehicle lateral direction. A stopper (not shown) is provided on the shock-absorbing rod 35, so that each of the first guide wheel supports 33 is prevented from rotating toward the inner side of the vehicle, and the interval between the first guide wheel supports 33 is thus not reduced. That is, the shock-absorbing rod 35 acts only against a force in the vehicle outer direction from the first guide wheels 16, and widens the interval between the first guide wheel supports 33 when the force acts thereon.

Also, in the present embodiment, as shown in FIG. 7, at the vehicle body center side portion 13*b* of the guide frame 13, a second pair of guide wheel supports 36 is provided so as to be arranged facing each other with the guide rail 4 therebetween. Each of the second guide wheel supports 36 is arranged so as to extend toward the vehicle body center side in the vehicle front and rear direction. A vehicle body end side portion 36*a* of each of the second guide wheel supports 36 is rotatably mounted to the guide frame 13 via a rotation shaft 37. Also, the second guide wheel 18 is rotatably mounted to a vehicle body center side portion 36*b* of each of the second guide wheel supports 36 via the rotation shaft 19.

Also, in the present embodiment, as shown in FIG. 7, the vehicle body center side portions 36*b* of the second pair of guide wheel supports 36 are connected to each other by a shock-absorbing rod 38 that extends in the vehicle lateral direction. A stopper (not shown) is provided on the shock-absorbing rod 38, so that each of the second guide wheel supports 36 is prevented from rotating toward the inner side of the vehicle, and the interval between the second guide wheel supports 36 is thus not reduced. That is, the shock-absorbing rod 38 acts only against a force in the vehicle outer direction from the second guide wheels 18, and widens the interval between the second guide wheel supports 36 when the force acts thereon.

Although not shown in the drawings, in the present embodiment, the bogie on the rear side of the vehicle 1 has the same features as those in the aforementioned embodiment.

As described above, in the bogie for the guide rail type vehicle according to the present embodiment, the first pair of guide wheel supports 33 is rotatably provided at the vehicle body end side portion 13*a* of the guide frame 13 so as to be arranged facing each other in the axle direction. Each of the first pair of guide wheels 16 is mounted to the vehicle body end side portion 13*a* of the guide frame 13 via each of the first pair of guide wheel supports 33. The first pair of guide wheels 16 is connected to each other by the shock-absorbing rod 35. The second pair of guide wheel supports 36 is rotatably provided at the vehicle body center side portion 13*b* of the guide frame 13 so as to be arranged facing each other in the axle direction. Each of the second pair of guide wheels 18 is mounted to the vehicle body center side portion 13*b* of the guide frame 13 via each of the second pair of guide wheel supports 36. The second pair of guide wheels 18 is connected to each other by the shock-absorbing rod 38. Thus, when the bogie 2 runs along the curved section of the guide rail 4 or a joint of the guide rail 4 or the like, an impact on the first and second guide wheels 16 and 18 is absorbed by the shock-absorbing rods 35 and 38, and is thus prevented from being transmitted to the guide frame 13 and the bogie 2. Accordingly, the running stability of the bogie 2 is improved, and the vehicle 1 can give a passenger a more comfortable ride. An impact on the first and second guide wheels 16 and 18 themselves is also reduced by the shock-absorbing rods 35 and 38, so that the operating life of the first and second guide wheels 16 and 18 can be extended.

Fifth Embodiment

Figure 8:
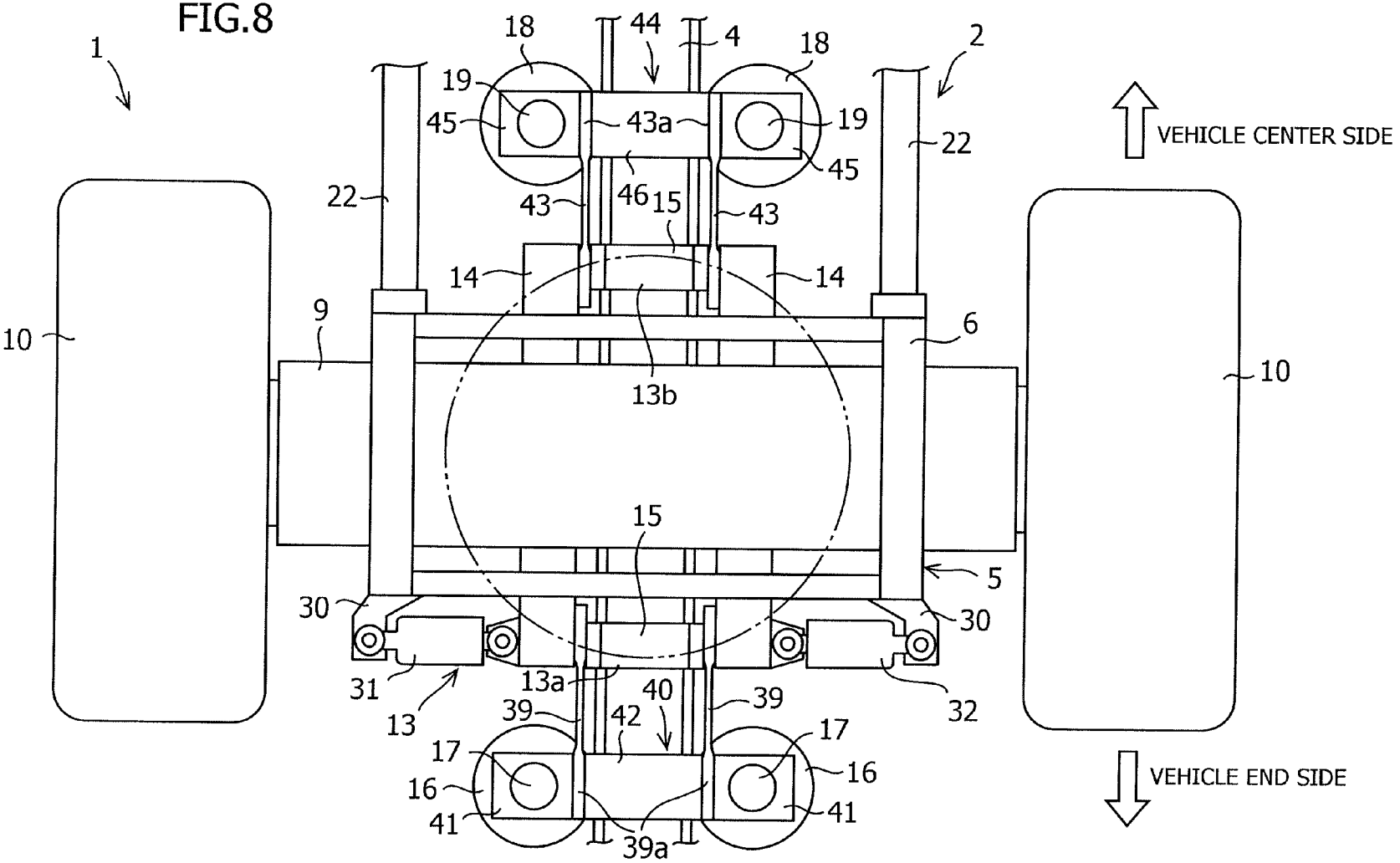
FIG. 8 is a plan view of a bogie on the front side in the vehicle front and rear direction of a guide rail type vehicle according to a fifth embodiment of the present invention.

In the following, a bogie for a guide rail type vehicle according to a fifth embodiment of the present invention will be described with reference to the drawings. FIG. 8 is a plan view of a bogie on the front side in the vehicle front and rear direction of a guide rail type vehicle according to the fifth embodiment of the present invention. In this embodiment, the same symbols are applied to elements that are the same as those explained in the above-described embodiments, and repeated explanation thereof is omitted.

In the present embodiment, as shown in FIG. 8, at the vehicle body end side portion 13*a* of the guide frame 13, a first pair of leaf springs 39 is provided so as to be arranged facing each other with the guide rail 4 therebetween. The first pair of leaf springs 39 is arranged extending toward the vehicle body end side, and a first split-type wheel receiver (a guide wheel supporting member) 40 is mounted to vehicle body end side portions 39*a* of the first pair of leaf springs 39.

The first split-type wheel receiver 40 includes a pair of guide wheel mounting parts 41 arranged at both end parts in the vehicle lateral direction, and a middle support part 42 arranged between the guide wheel mounting parts 41. The first guide wheel 16 is rotatably mounted to each of the guide wheel mounting parts 41 via the rotation shaft 17. Also, the vehicle body end side portion 39*a* of each of the first leaf springs 39 is held between each of the guide wheel mounting parts 41 and the middle support part 42.

Also, in the present embodiment, as shown in FIG. 8, at the vehicle body center side portion 13*b* of the guide frame 13, a second pair of leaf springs 43 is provided so as to be arranged facing each other with the guide rail 4 therebetween. The second pair of leaf springs 43 is arranged extending toward the vehicle body center side, and a second split-type wheel receiver (a guide wheel supporting member) 44 is mounted to vehicle body center side portions 43*a* of the second pair of leaf springs 43.

The second split-type wheel receiver 44 includes a pair of guide wheel mounting parts 45 arranged at both end parts in the vehicle lateral direction, and a middle support part 46 arranged between the guide wheel mounting parts 45. The second guide wheel 18 is rotatably mounted to each of the guide wheel mounting parts 45 via the rotation shaft 19. Also, the vehicle body center side portion 43*a* of each of the second leaf springs 43 is held between each of the guide wheel mounting parts 45 and the middle support part 46.

Although not shown in the drawings, in the present embodiment, the bogie on the rear side of the vehicle 1 has the same features as those in the aforementioned embodiment.

As described above, in the bogie for the guide rail type vehicle according to the present embodiment, the first pair of guide wheels 16 is supported by the first split-type wheel receiver 40. The first pair of leaf springs 39 are provided at the vehicle body end side portion 13*a* of the guide frame 13 so as to be arranged facing each other in the axle direction. The first split-type wheel receiver 40 is mounted to the vehicle body end side portion 13*a* of the guide frame 13 via the first pair of leaf springs 39. The second pair of guide wheels 18 is supported by the second split-type wheel receiver 44. The second pair of leaf springs 43 is provided at the vehicle body center side portion 13*b* of the guide frame 13 so as to be arranged facing each other in the axle direction. The second split-type wheel receiver 44 is mounted to the vehicle body center side portion 13*b* of the guide frame 13 via the second pair of leaf springs 43. Thus, when the bogie 2 runs along the curved section of the guide rail 4 or the joint of the guide rail or the like, an impact on the first and second guide wheels 16 and 18 is absorbed by the first and second leaf springs 39 and 43, and is thus prevented from being transmitted to the guide frame 13 and the bogie 2. Accordingly, the running stability of the bogie 2 is improved, and the vehicle 1 can give a passenger a more comfortable ride. An impact on the first and second guide wheels 16 and 18 themselves is also reduced by the first and second leaf springs 39 and 43, so that the operating life of the first and second guide wheels 16 and 18 can be extended.

Moreover, the leaf springs, which are not a wear component, are used to connect the first and second split-type wheel receivers 40 and 44 and the guide frame 13. Thus, the replacement cycle becomes longer, and the maintainability is also improved.

Sixth Embodiment

Figure 9:
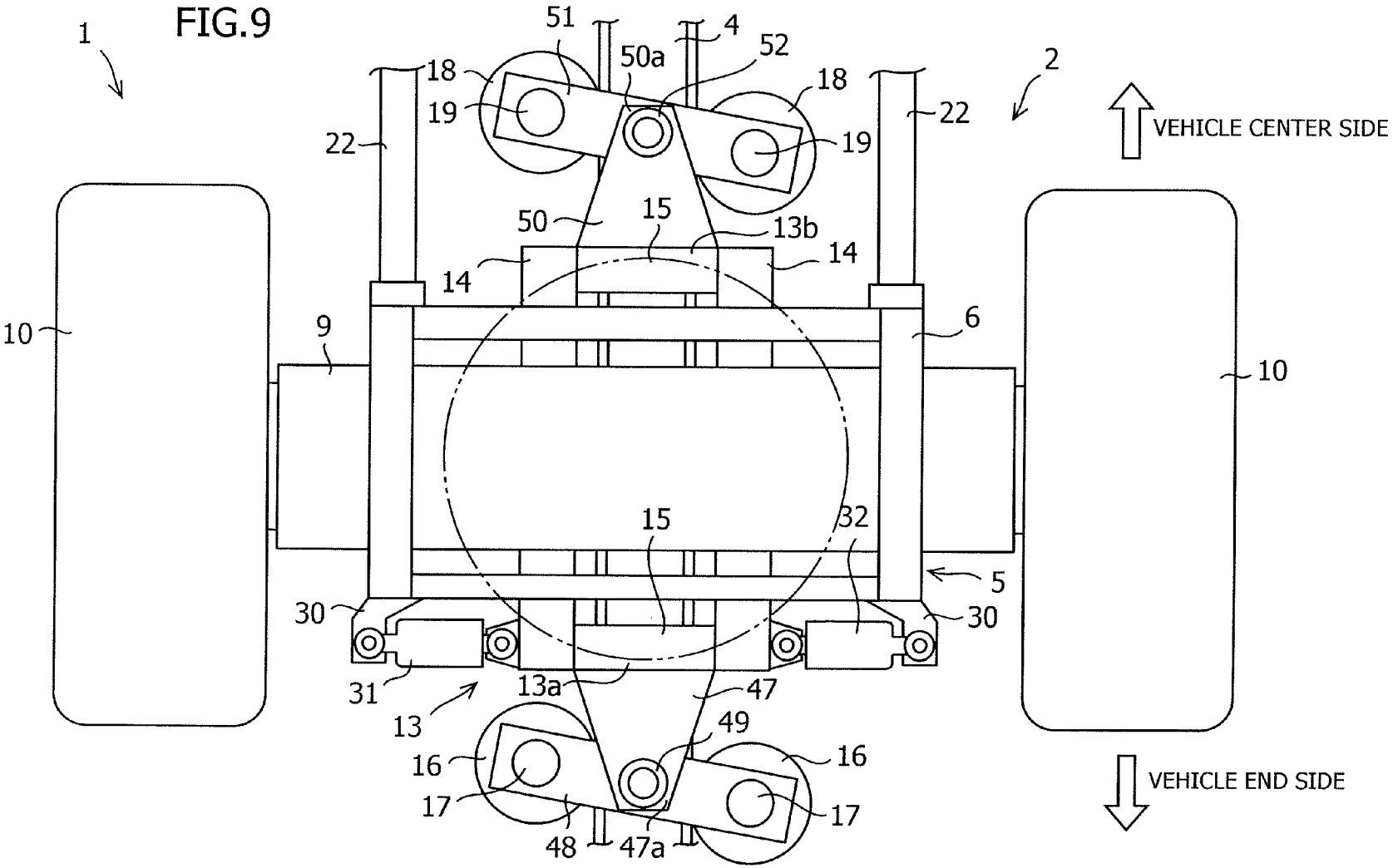
FIG. 9 is a plan view of a bogie on the front side in the vehicle front and rear direction of a guide rail type vehicle according to a sixth embodiment of the present invention.

In the following, a bogie for a guide rail type vehicle according to a sixth embodiment of the present invention will be described with reference to the drawings. FIG. 9 is a plan view of a bogie on the front side in the vehicle front and rear direction of a guide rail type vehicle according to the sixth embodiment of the present invention. In this embodiment, the same symbols are applied to elements that are the same as those explained in the above-described embodiments, and repeated explanation thereof is omitted.

In the present embodiment, as shown in FIG. 9, at the vehicle body end side portion 13*a* of the guide frame 13, a first link support 47 is provided so as to extend toward the vehicle body end side. The first link support 47 is formed in a trapezoidal shape in a plan view. At a vehicle body end side portion 47*a* of the first link support 47, a first link 48 is mounted so as to tilt relative to the guide rail 4.

The first pair of guide wheels 16 is rotatably mounted to both end parts in the vehicle lateral direction of the first link 48 via the rotation shafts 17. Each of the first guide wheels 16 contacts with the outer side surface 4*a* (see FIG. 2) of the guide rail 4 in the state in which the first link 48 tilts relative to the guide rail 4.

Also, the first link 48 is rotatably mounted to the first link support 47 via a first rubber vibration isolator (a shock-absorbing mechanism) 49 having a restoration function. The first link 48 is returned to an original tilting position by the restoration function of the first rubber vibration isolator 49 after rotation. The inner width between the first guide wheels 16 mounted to the both end parts of the first link 48 has a maximum value when the first link 48 is perpendicular to the guide rail 4, and is not structurally widened any more. That is, such a structure itself as to mount the first link 48 rotatably to the first link support 47 also works as a stopper to limit the inner width between the first guide wheels 16.

Also, in the present embodiment, as shown in FIG. 9, at the vehicle body center side portion 13*b* of the guide frame 13, a second link support 50 is provided so as to extend toward the vehicle body center side. The second link support 50 is formed in a trapezoidal shape in a plan view. At a vehicle body center side portion 50*a* of the second link support 50, a second link 51 is mounted so as to tilt relative to the guide rail 4.

The second guide wheels 18 are rotatably mounted to both end parts in the vehicle lateral direction of the second link 51 via the rotation shafts 19. Each of the second guide wheels 18 contacts with the outer side surface 4*a* (see FIG. 2) of the guide rail 4 in the state in which the second link 51 tilts relative to the guide rail 4.

Also, the second link 51 is rotatably mounted to the second link support 50 via a second rubber vibration isolator (a shock-absorbing mechanism) 52 having a restoration function. The second link 51 is returned to an original tilting position by the restoration function of the second rubber vibration isolator 52 after rotation. The inner width between the second guide wheels 18 mounted to the both end parts of the second link 51 has a maximum value when the second link 51 is perpendicular to the guide rail 4, and is not structurally widened any more. That is, such a structure itself so as to mount the second link 51 rotatably to the second link support 50 also works as a stopper to limit the inner width between the second guide wheels 18.

Although not shown in the drawings, in the present embodiment, the bogie on the rear side of the vehicle 1 has the same features as those in the aforementioned embodiment.

As described above, in the bogie for the guide rail type vehicle according to the present embodiment, the first pair of guide wheels 16 is connected to each other by the first link 48 arranged tilting relative to the guide rail 4. The first link support 47 is provided at the vehicle body end side portion 13*a* of the guide frame 13 so as to extend toward the vehicle body end side. The first link 48 is rotatably mounted to the first link support 47 via the first rubber vibration isolator 49 having the restoration function. The second pair of guide wheels 18 is connected to each other by the second link 51 arranged tilting relative to the guide rail 4. The second link support 50 is provided at the vehicle body center side portion 13*b* of the guide frame 13 so as to extend toward the vehicle body center side. The second link 51 is rotatably mounted to the second link support 50 via the second rubber vibration isolator 52 having the restoration function. Thus, when the bogie 2 runs along the curved section of the guide rail 4 or the joint of the guide rail 4, an impact on the first and second guide wheels 16 and 18 is absorbed by the rotating first and second links 48 and 51, and is thus prevented from being transmitted to the guide frame 13 and the bogie 2. Accordingly, the running stability of the bogie 2 is improved, and the vehicle 1 can give a passenger a more comfortable ride. An impact on the first and second guide wheels 16 and 18 themselves is also reduced by the rotating first and second links 48 and 51, so that the operating life of the first and second guide wheels 16 and 18 can be extended.

Also, even when an abnormal load is applied to the first and second guide wheels 16 and 18, the first and second links 48 and 51 can be more reliably restored to the original tilting position by using the first and second rubber vibration isolators 49 and 52.

Moreover, the inner widths between the first and second guide wheels 16 and 18 mounted to the both end parts of the first and second links 48 and 51 have a maximum value when the first and second links 48 and 51 are perpendicular to the guide rail 4, and are not structurally widened any more. That is, such a structure itself as to respectively mount the first and second links 48 and 51 rotatably to the first and second link supports 47 and 50 also works as a stopper to limit the inner widths between the first and second guide wheels 16 and 18.

The embodiments of the present invention have been described above. It should be noted that the present invention is not limited to the aforementioned embodiments, and various modifications and changes may be made therein based on the technical concepts of the present invention.

Figure 10A:
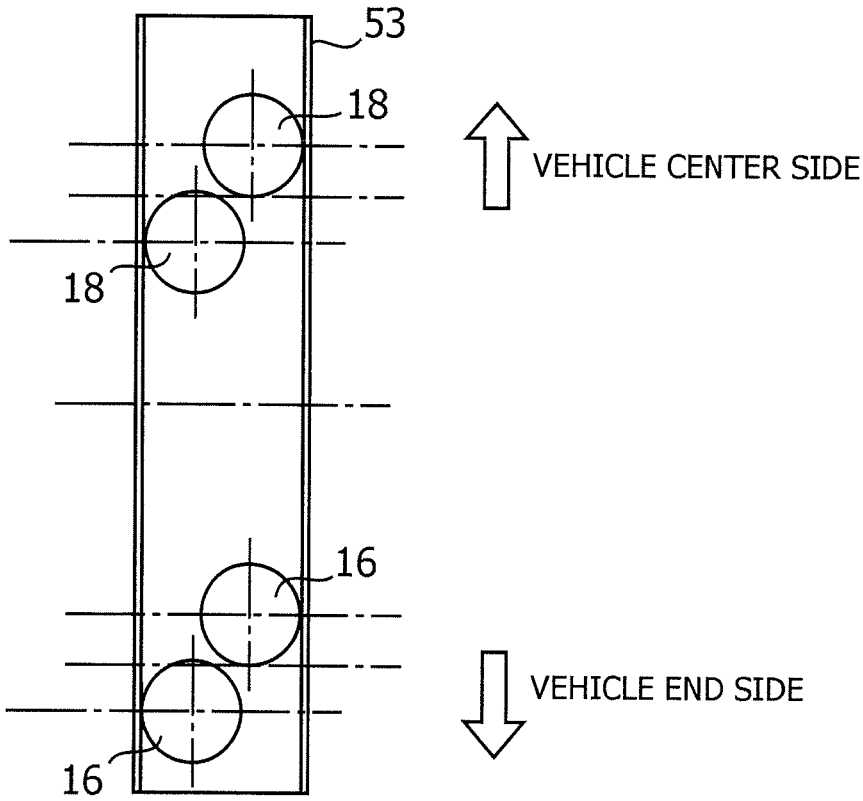
FIG. 10 are views illustrating a modification of a guide rail of the guide rail type vehicle according to the present invention.
Figure 10B:
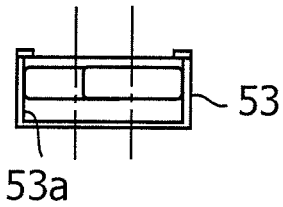
Figure 11:
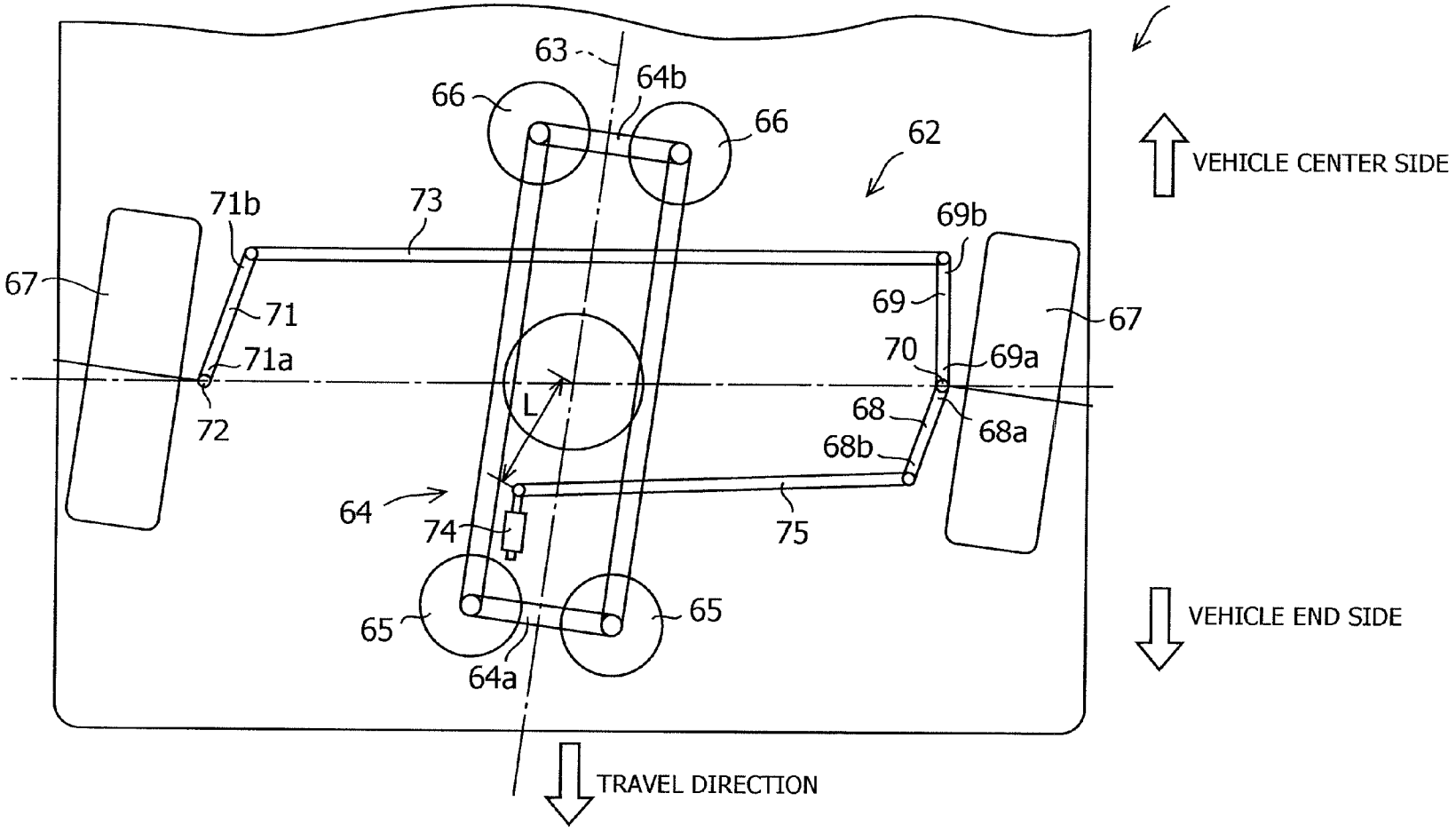
FIG. 11 is a plan view of a bogie on the front side in the vehicle front and rear direction of a conventional guide rail type vehicle.

Although the guide rail 4 is formed in an H shape in section in the aforementioned first to sixth embodiments, a guide rail 53 may be formed in a U shape in section as shown in FIGS. 10 (*a*) and (*b*).

In this case, as shown in FIG. 10(*a*), the first pair of guide wheels 16 is arranged at the guide frame 13 so as to be adjacent to each other in the axle direction. Similarly, the second pair of guide wheels 18 is arranged at the guide frame 13 so as to be adjacent to each other in the axle direction. Also, as shown in FIG. 10(*b*), the first and second guide wheels 16 and 18 contact with inner side surfaces 53*a* of the guide rail 53.

Although the stopper 28 and the stopper receivers 29 are formed in a rectangular parallelepiped shape in the aforementioned first to sixth embodiments, any other shape may be employed as long as the displacement of the bogie in the vehicle lateral direction is suppressed.

Although the stopper 28 is provided on the upper surface 9*b* of the axle 9 and the pair of stopper receivers 29 is provided on the suspension frame 21 in the aforementioned first to sixth embodiments, the present invention is not limited thereto. A pair of stopper receivers may be provided on the axle 9, and a stopper may be provided on the suspension frame 21.

Although the stopper is provided on the shock-absorbing rods 35 and 38 in the aforementioned fourth embodiment, the first and second guide wheel supports 33 and 36 may be prevented from rotating toward the inner side of the vehicle without using the stopper. For example, the configuration may be such that when the first and second guide wheel supports 33 and 36 rotate toward the inner side of the vehicle, the guide frame-side end parts of the first and second guide wheel supports 33 and 36 contact with the guide frame 13, whereby the first and second guide wheel supports 33 and 36 are prevented from rotating toward the inner side of the vehicle.

Although the first rubber vibration isolator 49 and the second rubber vibration isolator 52 are used as the shock-absorbing mechanism in the aforementioned sixth embodiment, the present invention is not limited thereto. As long as the first link 48 and the second link 51 are returned to the original tilting position after rotating, any other member having a torsion action, such as a torsion spring, may be used.

REFERENCE SYMBOLS LIST

1 Vehicle
2 Bogie
3 Guideway
4, 53 Guide rail
4*a*, 53*a* Side surface of guide rail
5 Turn frame
6 Upper rectangular frame
6*a* Vehicle body center side portion of upper rectangular frame
7 Lower rectangular frame
7*a* Vehicle body center side portion of lower rectangular frame
7*b* Vehicle body end side portion of lower rectangular frame
8 Connecting frame
9 Axle
9*a* Lower surface of axle
9*b* Upper surface of axle
Running wheel
11, 12 Bearing
Guide frame
13*a* Vehicle body end side portion of guide frame
13*b* Vehicle body center side portion of guide frame
14 Longitudinal frame
14*a* Vehicle body end side portion of longitudinal frame
15 Lateral frame
16, 18 Guide wheel
17, 19, 34, 37 Rotation shaft
20 Vehicle body
20*a* Lower surface of vehicle body
21 Suspension frame
21*a* Vehicle body center side portion of suspension frame
21*b* Extension part
22, 25 Traction link
22*a*, 25*a* End part on vehicle body end side of traction link
22*b*, 25*b* End part on vehicle body center side of traction link
23, 24, 26, 27 Joint
28 Stopper
29 Stopper receiver
30 Arm
30*a* End part on vehicle body end side of arm
31 Turn damper
32 Restoration rod
33, 36 Guide wheel support
33*a*, 36*b* Vehicle body center side portion of guide wheel support
33*b*, 36*a* Vehicle body end side portion of guide wheel support
35, 38 Shock-absorbing rod
39, 43 Leaf spring
39*a* Vehicle body end side portion of leaf spring

40, 44 Split-type wheel receiver
41, 45 Guide wheel mounting part of split-type wheel receiver
42, 46 Middle support part of split-type wheel receiver
43*a* Vehicle body center side portion of leaf spring
47, 50 Link support
48, 51 Link
49, 52 Rubber vibration isolator
61 (Conventional) guide rail type vehicle
62 (Conventional) bogie
63 (Conventional) guide rail
64 (Conventional) guide frame
65, 66 (Conventional) guide wheel
67 (Conventional) running wheel
68 (Conventional) steering lever
69, 71 (Conventional) link lever
70, 72 (Conventional) rotation shaft
73 (Conventional) tie rod
74 (Conventional) actuator
75 (Conventional) steering rod
$O_1$ Center axis of axle
$L_1$ Distance between center axis of axle and first pair of guide wheels
$L_2$ Distance between center axis of axle and second pair of guide wheels

The invention claimed is:

1. A bogie for a guide rail type vehicle configured to be steered by being guided by a guide rail provided on a predetermined guideway when the bogie runs along the guideway, the bogie comprising:

a turn frame arranged below a vehicle body and connected to the vehicle body;

an axle having a pair of running wheels and turnably mounted to the turn frame via a bearing;

a guide frame mounted to the axle and extending in a vehicle front and rear direction;

a first pair of guide wheels adjacent to each other in an axle direction, the first pair of guide wheels configured to contact the guide rail, and rotatably provided at a vehicle body end side portion in the vehicle front and rear direction of the guide frame;

a second pair of guide wheels adjacent to each other in the axle direction, the second pair of guide wheels configured to contact the guide rail, and rotatably provided at a vehicle body center side portion in the vehicle front and rear direction of the guide frame;

a stopper projecting from an upper surface on a vehicle body side of the axle toward the vehicle body;

a pair of stopper receivers facing each other at intervals from the stopper in a vehicle lateral direction, and projecting from the vehicle body toward the axle;

a turn damper configured to connect between the guide frame and the turn frame, to suppress a turning operation of the guide frame; and a restoration rod configured to connect between the guide frame and the turn frame, to restore the guide frame to a straight-running state after the turning operation of the guide frame.

2. The bogie for the guide rail type vehicle according to claim 1, further comprising:

a first pair of guide wheel supports rotatably provided at the vehicle body end side portion of the guide frame and facing each other in the axle direction, each of the first pair of guide wheels being mounted to the vehicle body end side portion of the guide frame via a corresponding one of the first pair of guide wheel supports, and the first pair of guide wheels being connected to each other by a shock-absorbing rod; and a second pair of guide wheel supports rotatably provided at the vehicle body center side portion of the guide and facing each other in the axle direction, each of the second pair of guide wheels being mounted to the vehicle body center side portion of the guide frame via a corresponding one of the second pair of guide wheel supports, and the second pair of guide wheels being connected to each other by a shock-absorbing rod.

3. The bogie for the guide rail type vehicle according to claim 1, further comprising:

a first guide wheel supporting member which connects the first pair of guide wheels to each other;

a first pair of leaf springs provided at the vehicle body end side portion of the guide frame and facing each other in the axle direction, and the first guide wheel supporting member being mounted to the vehicle body end side portion of the guide frame via the first pair of leaf springs;

a second guide wheel supporting member which connects the second pair of guide wheels to each other; and a second pair of leaf springs provided at the vehicle body center side portion of the guide frame and facing each other in the axle direction, and the second guide wheel supporting member being mounted to the vehicle body center side portion of the guide frame via the second pair of leaf springs.

4. The bogie for the guide rail type vehicle according to claim 1, further comprising:

a first link which connects the first pair of guide wheels to each other, and is arranged tilting relative to the guide rail;

a first link support which is provided at the vehicle body end side portion of the guide frame and extends toward a vehicle body end side in the vehicle front and rear direction, and the first link being rotatably mounted to the first link support via a first shock-absorbing mechanism having a restoration function;

a second link which connects the second pair of guide wheels to each other, and is arranged tilting relative to the guide rail; and a second link support which is provided at the vehicle body center side portion of the guide frame and extends toward a vehicle body center side in the vehicle front and rear direction, and the second link being rotatably mounted to the second link support via a second shock-absorbing mechanism having a restoration function.

5. A bogie for a guide rail type vehicle configured to be steered by being guided by a guide rail provided on a predetermined guideway when the bogie runs along the guideway, the bogie comprising:

a turn frame arranged below a vehicle body and connected to the vehicle body;

an axle having a pair of running wheels and turnably mounted to the turn frame via a bearing;

a guide frame mounted to the axle and extending in a vehicle front and rear direction;

a first pair of guide wheels adjacent to each other in an axle direction, the first pair of guide wheels configured to contact the guide rail, and rotatably provided at a vehicle body end side portion in the vehicle front and rear direction of the guide frame;

a second pair of guide wheels adjacent to each other in the axle direction, the second pair of guide wheels configured to contact the guide rail, and rotatably provided at a vehicle body center side portion in the vehicle front and rear direction of the guide frame;

a stopper projecting from an upper surface on a vehicle body side of the axle toward the vehicle body;

a pair of stopper receivers facing each other at intervals from the stopper in a vehicle lateral direction, and projecting from the vehicle body toward the axle, wherein the turn frame includes an upper rectangular frame, a lower rectangular frame, and a plurality of connecting frames that extend in the vehicle verticle direction to connect the upper rectangular frame and the lower rectangular frame so that the turn frame is assembled in a rectangular parallelepiped shape through which the axle is arranged, the axle is turnably mounted via arc-shaped bearings arranged between the upper rectangular frame and the lower rectangular frame, and the guide frame is arranged at an offset position relative to a center axis of the axle toward a vehicle body end side in the vehicle front and rear direction such that a distance between the center axis of the axle and the first pair of guide wheels is greater than a distance between the center axis of the axle and the second pair of guide wheels.

6. The bogie for the guide rail type vehicle according to claim 5, further comprising:

a first pair of guide wheel supports rotatably provided at the vehicle body end side portion of the guide frame and facing each other in the axle direction, each of the first pair of guide wheels being mounted to the vehicle body end side portion of the guide frame via a corresponding one of the first pair of guide wheel supports, and the first pair of guide wheels being connected to each other by a shock-absorbing rod; and a second pair of guide wheel supports rotatably provided at the vehicle body center side portion of the guide frame and facing each other in the axle direction, each of the second pair of guide wheels being mounted to the vehicle body center side portion of the guide frame via a corresponding one of the second pair of guide wheel supports, and the second pair of guide wheels being connected to each other by a shock-absorbing rod.

7. A bogie for a guide rail type vehicle configured to be steered by being guided by a guide rail provided on a predetermined guideway when the bogie runs along the guideway, the bogie comprising:

a turn frame arranged below a vehicle body and connected to the vehicle body;

an axle having a pair of running wheels and turnably mounted to the turn frame via a bearing;

a guide frame mounted to the axle and extending in a vehicle front and rear direction;

a first pair of guide wheels adjacent to each other in an axle direction, the first pair of guide wheels configured to contact with the guide rail, and rotatably provided at a vehicle body end side portion in the vehicle front and rear direction of the guide frame;

a second pair of guide wheels adjacent to each other in the axle direction, the second pair of guide wheels configured to contact the guide rail, and rotatably provided at a vehicle body center side portion in the vehicle front and rear direction of the guide frame;

a stopper projecting from an upper surface on a vehicle body side of the axle toward the vehicle body;

a pair of stopper receivers facing each other at intervals from the stopper in a vehicle lateral direction, and projecting from the vehicle body toward the axle, wherein the guide frame is arranged at an offset position relative to a center axis of the axle toward a vehicle body end side in the vehicle front and rear direction such that a distance between the center axis of the axle and the first pair of guide wheels is greater than a distance between the center axis of the axle and the second pair of guide wheels;

a first guide wheel supporting member which connects the first pair of guide wheels to each other;

a first pair of leaf springs provided at the vehicle body end side portion of the guide frame and facing each other in the axle direction, and the first guide wheel supporting member being mounted to the vehicle body end side portion of the guide frame via the first pair of leaf springs;

a second guide wheel supporting member which connects the second pair of guide wheels to each other; and a second pair of leaf springs provided at the vehicle body center side portion of the guide frame and facing each other in the axle direction, and the second guide wheel supporting member being mounted to the vehicle body center side portion of the guide frame via the second pair of leaf springs.

8. The bogie for the guide rail type vehicle according to claim 5, further comprising:

a first link which connects the first pair of guide wheels to each other, and is arranged tilting relative to the guide rail;

a first link support which is provided at the vehicle body end side portion of the guide frame and extends toward the vehicle body end side in the vehicle front and rear direction, and the first link being rotatably mounted to the first link support via a first shock-absorbing mechanism having a restoration function;

a second link which connects the second pair of guide wheels to each other, and is arranged tilting relative to the guide rail; and a second link support which is provided at the vehicle body center side portion of the guide frame and extends toward a vehicle body center side in the vehicle front and rear direction, and the second link being rotatably mounted to the second link support via a second shock-absorbing mechanism having a restoration function.

* * * * *